US010934825B2

(12) United States Patent
An et al.

(10) Patent No.: US 10,934,825 B2
(45) Date of Patent: Mar. 2, 2021

(54) PRESSURIZING AND PROTECTING A PARENT WELL DURING FRACTURING OF A CHILD WELL

(71) Applicant: HALLIBURTON ENERGY SERVICES, INC., Houston, TX (US)

(72) Inventors: Jun Su An, Houston, TX (US); Robert Douglas Hillard, Houston, TX (US)

(73) Assignee: Halliburton Energy Services, INC., Houston, TX (US)

( * ) Notice: Subject to any disclaimer, the term of this patent is extended or adjusted under 35 U.S.C. 154(b) by 0 days.

(21) Appl. No.: 16/457,153

(22) Filed: Jun. 28, 2019

(65) Prior Publication Data

US 2020/0408077 A1 Dec. 31, 2020

(51) Int. Cl.

| | |
|---|---|
| ***E21B 43/26*** | (2006.01) |
| ***E21B 47/09*** | (2012.01) |
| ***E21B 47/003*** | (2012.01) |

(52) U.S. Cl.

CPC ..... *E21B 43/261* (2013.01); *E21B 47/003* (2020.05); *E21B 47/09* (2013.01)

(58) Field of Classification Search

CPC ..... E21B 43/25; E21B 43/26; E21B 43/2605; E21B 43/2607; E21B 43/261; E21B 43/267; E21B 43/27; E21B 47/09

See application file for complete search history.

(56) References Cited

U.S. PATENT DOCUMENTS

| | | | | |
|---|---|---|---|---|
| 3,709,295 | A * | 1/1973 | Braunlich, Jr. | E21B 43/17 166/245 |
| 4,005,750 | A * | 2/1977 | Shuck | E21B 43/17 166/308.1 |
| 4,724,905 | A * | 2/1988 | Uhri | E21B 43/17 166/250.1 |
| 4,830,106 | A * | 5/1989 | Uhri | E21B 43/26 166/250.1 |
| 4,836,284 | A * | 6/1989 | Tinker | C09K 8/72 166/279 |

(Continued)

OTHER PUBLICATIONS

Mary, "An Eagle Ford Case Study: Improving an Infill Well Completion Through Optimized Refracturing Treatment of the Offset Parent Wells", Society of Petroleum Engineers, SPE Hydraulic Fracturing Technology Conference and Exhibition, Feb. 5-7, 2019, 11 pages.

(Continued)

*Primary Examiner* — Angela M DiTrani Leff

(74) *Attorney, Agent, or Firm* — Kilpatrick Townsend & Stockton LLP

(57) ABSTRACT

A method for protecting a wellbore includes identifying a parent wellbore and a child wellbore and identifying a parent well stage along the parent wellbore that has the potential to interact with a child well stage along the child wellbore while the child well stage undergoes hydraulic fracturing. The method further includes pumping a treatment fluid downhole to the parent well stage for pressurizing the parent well stage to a pressure that is equal to or greater than the pressure in the child well stage while the child well stage undergoes hydraulic fracturing and maintaining the pressure in the parent well stage that is equal to or greater than the pressure in the child well stage while the child well stage undergoes hydraulic fracturing.

18 Claims, 7 Drawing Sheets

(56) References Cited

U.S. PATENT DOCUMENTS

| | | | | |
|---|---|---|---|---|
| 5,261,489 | A * | 11/1993 | Jennings, Jr. | E21B 43/26 166/271 |
| 5,765,642 | A | 6/1998 | Surjaatmadja | |
| 7,225,869 | B2 | 6/2007 | Willett et al. | |
| 8,915,297 | B2 | 12/2014 | Surjaatmadja et al. | |
| 9,410,406 | B2 * | 8/2016 | Yuan | E21B 43/26 |
| 9,683,165 | B2 * | 6/2017 | Mendell | E21B 43/26 |
| 2013/0220604 | A1 * | 8/2013 | El-Rabaa | E21B 43/26 166/259 |
| 2014/0246194 | A1 * | 9/2014 | Artus | E21B 43/17 166/271 |
| 2015/0211347 | A1 * | 7/2015 | Snider | E21B 34/10 166/250.01 |
| 2016/0273327 | A1 | 9/2016 | Nguyen et al. | |
| 2016/0312594 | A1 * | 10/2016 | Kuchuk | E21B 43/267 |
| 2018/0003033 | A1 * | 1/2018 | Dawson | E21B 47/06 |
| 2018/0238158 | A1 * | 8/2018 | Inyang | C09K 8/5756 |
| 2019/0106971 | A1 * | 4/2019 | Mendell | C09K 8/703 |
| 2019/0128110 | A1 | 5/2019 | Spicer et al. | |
| 2019/0146115 | A1 | 5/2019 | Mayo et al. | |
| 2019/0153841 | A1 * | 5/2019 | Randall | E21B 43/26 |

OTHER PUBLICATIONS

PCT Application No. PCT/US2020/027609 , International Search Report and Written Opinion, dated Jul. 27, 2020, 16 pages.

* cited by examiner

PRESSURIZING AND PROTECTING A PARENT WELL DURING FRACTURING OF A CHILD WELL

TECHNICAL FIELD

The present disclosure relates generally to hydraulic fracturing in a well, particularly (although not exclusively), this disclosure relates to pressurizing and protecting a parent well during fracturing of a child well.

BACKGROUND

Stimulation of a well, including but not limited to fracturing, can be used to extract hydrocarbons from a subterranean formation (e.g., an oil well or a gas well). For example, hydraulic fracturing can include pumping a treatment fluid that includes a proppant mixture into a wellbore. The treatment fluid can create or enhance fractures in the subterranean formation and the proppant mixture can fill the fractures to prop the fractures open. Propping the fractures open can allow the hydrocarbons to flow from the subterranean formation through the fractures and into the wellbore. In some examples, the wellbore is divided into stages (also known as intervals or zones) such that each stage includes one or more fracture clusters and each fracture cluster includes one or more fractures.

As more wells are drilled, the spacing between each well may decrease, which may increase the chances of an inter-well communication event, which hereinafter is referred to as a "frac hit," in which a pressure within a first well (e.g., a "parent well") is affected by the hydraulic fracturing in a second well (e.g., a "child well" or an "infill well") to cause an interaction between the parent well and the child well. In some aspects, fracturing treatment of the child well causes a fracture to grow towards the parent well when the reservoir pressure around the parent well is lower than the unstimulated/unproduced reservoir surrounding the child well. Frac hits can result in a loss of production of both the parent well and the child well. Frac hits can also result in mechanical, physical, or chemical damage to the parent well.

DETAILED DESCRIPTION

Figure 1A:
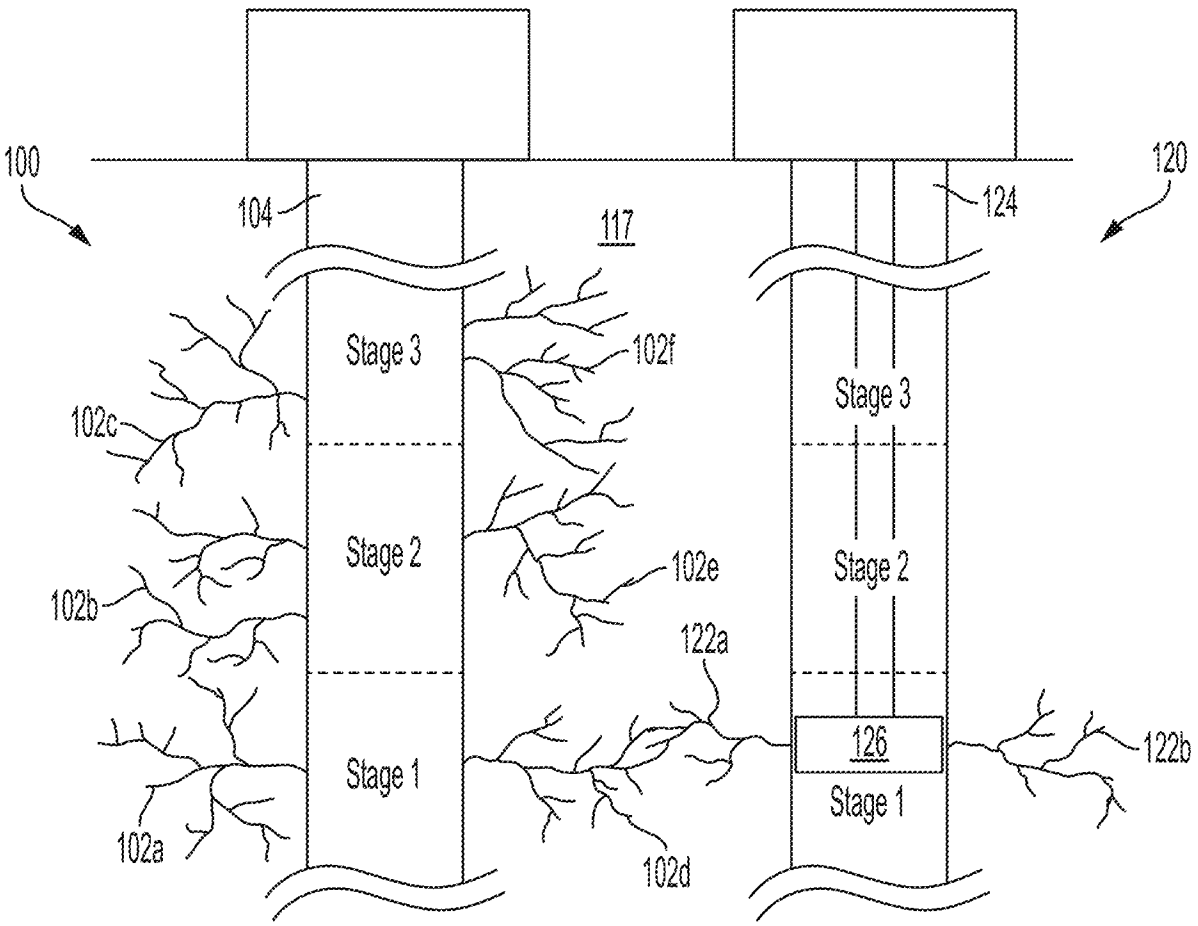
FIGS. 1A and 1B are cross-sectional views of examples of two well systems identified as a parent well and a child well according to some aspects of the present disclosure.

Certain aspects and examples of the disclosure relate to methods for pressurizing and protecting a parent well during stimulation (e.g. fracturing) of a child well. In some aspects, the method may include identifying one or more select stages or regions of a parent well that may experience a frac hit during fracturing of a particular stage or region of a child well. The method may further include selectively pressurizing the identified select stage(s) of the parent well prior to and during fracturing of the particular stage of the child well. Identification and pressurization of a select stage of the parent well during fracturing (e.g. hydraulic fracturing) of the particular stage of the child well can reduce the chances of the parent well experiencing a frac hit during stimulation of the child well. The select stage of the parent well may be pressurized using a pinpoint stimulation system, for example but not limited to a system using coiled tubing that injects a treatment fluid into the parent well to the desired stage or desired stages. The treatment fluid may be a myriad of different fluids, which may include a liquid, a gas, or a mixture of liquids and gases. The pinpoint stimulation system may perform a method including but not limited to, Halliburton's SURGIFRAC® method, which allows for selective fracturing of a well by combining hydrajetting and fracturing techniques.

The select stage(s) of the parent well likely to be affected by the fracturing of the particular stage of the child well can be protected via this pressurization by increasing a pressure at and around the select stage(s) (hereinafter a "dynamic pressure cloud"). The dynamic pressure cloud created at the select stage(s) of the parent well may correspond to a pressure at the select stage(s) that is equal to or greater than a pressure at the particular stage of the child well during the fracturing. The pressure at the select stage(s) of the parent well can be monitored during the treatment of the particular stage of the child well.

In response to a change in the pressure at the select stage(s) of the parent well, the pinpoint stimulation system may alter a characteristic of the fluid injected into the parent well (including but not limited to the rate of injection) to maintain the dynamic pressure cloud at the select stage(s) of the parent well.

For each subsequent stage of the child well that is fractured, a corresponding select stage(s) may be identified in the parent well and selectively treated via the pinpoint stimulation system to produce a dynamic pressure cloud at the select stage(s) in the parent well that have been identified. This stimulation on a stage-by-stage basis may prevent frac hits from occurring during the fracturing of the various stages of the child well.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1A is a cross-sectional view of two well systems 100, 120. According to some aspects of the present disclosure, the well system 100 may be a parent well (hereinafter "parent well" 100) and the well system 120 may be a child well (hereinafter "child well" 120). The parent well 100 and the child well 120 may each include a wellbore, a parent wellbore 104 and a child wellbore 124, respectively, extending from a surface and drilled into the ground through a subterranean formation 117 for extracting hydrocarbons (e.g., natural gas or oil) from the subterranean formation 117. Both the parent wellbore 104 and the child wellbore 124 are shown as vertical wellbores; however, in some aspects the parent wellbore 104 and the child wellbore 124 may be lateral wellbores that extend substantially horizontally from the vertical wellbores.

In some aspects, the parent well 100 may be an existing production well, and the child well 120 may be a newly drilled well. The parent well 100 may have undergone hydraulic fracturing so that fractures 102*a-f* are formed in the subterranean formation 117 surrounding the parent well 100. These fractures 102*a-f* may permit the hydrocarbons to flow from the formation 117 into the parent well 100.

The child wellbore 124 of the child well 120 may extend through the same subterranean formation 117 as the parent wellbore 104 of the parent well 100. The child wellbore 124 may by positioned at such a distance from the parent wellbore 104 that the hydraulic fracturing process in the child well 120 has the potential to cause a frac hit, or an interaction, with the parent well 100. Additionally, the distance between the parent wellbore 104 and the child wellbore 124, the type of rock that the subterranean formation 117 is formed from, the pressure that the child wellbore 124 is subjected to during the hydraulic fracturing process, and the distance between the fractures 102*a-f* of the parent well 100 and the fractures 122*a-b* of the child well 120 may each be factors in determining whether the hydraulic fracturing process in the child well 120 has the potential to interact with the parent well 100.

In some aspects, the frac hit may be the connection of the newly formed fractures 122*a-b* of the child well 120 with the existing fractures 102*a-f* of the parent well 100. In some aspects, the child well 120 may be fractured via a fracturing system 126. The fracturing system 126 may be a pinpoint stimulation system that may perform a method including, but not limited to, Halliburton's SURGIFRAC® method, which allows for selective fracturing of a well by combining hydrajetting and fracturing techniques.

Each of the parent well 100 and the child well 120 may be divided into segments called stages. Each stage has one or more corresponding fractures (e.g., 102*a-f*, 122*a*, 122*b*). FIG. 1A depicts each of the parent well 100 and the child well 120 divided into three stages (e.g., Stage 1, Stage 2, Stage 3). Each stage of the parent well 100 and the child well 120 may be a different length or may be an equal length to other stages within the same well system 100, 120. Additionally, while each corresponding stage in the parent well 100 and the child well 120 are depicted as being the same length as each other (e.g., the length of Stage 2 in the parent well 100 is equal to the length of Stage 2 in child well 120), the corresponding stages in each of the parent well 100 and the child well 120 may be different lengths. In some aspects, the length of a stage may depend on the number of fractures 102*a-f*, 122*a*, 122*b* along the length of the respective parent well 100 and child well 120.

The child well 120 may be fractured by deploying the fracturing system 126 to the most downhole stage then moving the fracturing system 126 up the child wellbore to fracture each adjacent stage (e.g., Stage 1 of the child well 120 may be fractured first, then Stage 2, then Stage 3). In some aspects, the child well 120 may be fractured by first fracturing the most uphole stage then moving to fracture each adjacent stage until reaching the most downhole stage (e.g., Stage 3 of the child well 120 may be fractured first, then Stage 2, then Stage 1). However, the child well 120 may be fractured in any other suitable order not expressly discussed here.

During fracturing of the child well 120, a stage of the child well 120 is identified as the stage that will undergo the hydraulic fracturing. A stage of the parent well 100 that lies in substantially the same plane as the identified stage of the child well 120 is identified as having the potential to have a frac hit during the hydraulic fracturing of the identified stage of the child well 120. For example in FIG. 1A, Stage 3 of the parent well 100 is identified and determined to have the potential to interact with Stage 3 of the child well 120 while Stage 3 of the child well 120 is undergoing hydraulic fracturing. As other stages of the child well 120 are hydraulically fractured, the stage of the child well 120 undergoing hydraulic fracturing corresponds to the identified stage of the parent well 100 with which the identified child well stage has the potential for interaction. For example, Stage 2 of the parent well 100 is identified and determined to have the potential to interact with Stage 2 of the child well 120 and Stage 1 of the parent well 100 is identified and determined to have the potential to interact with Stage 1 of the child well 120.

Figure 1B:
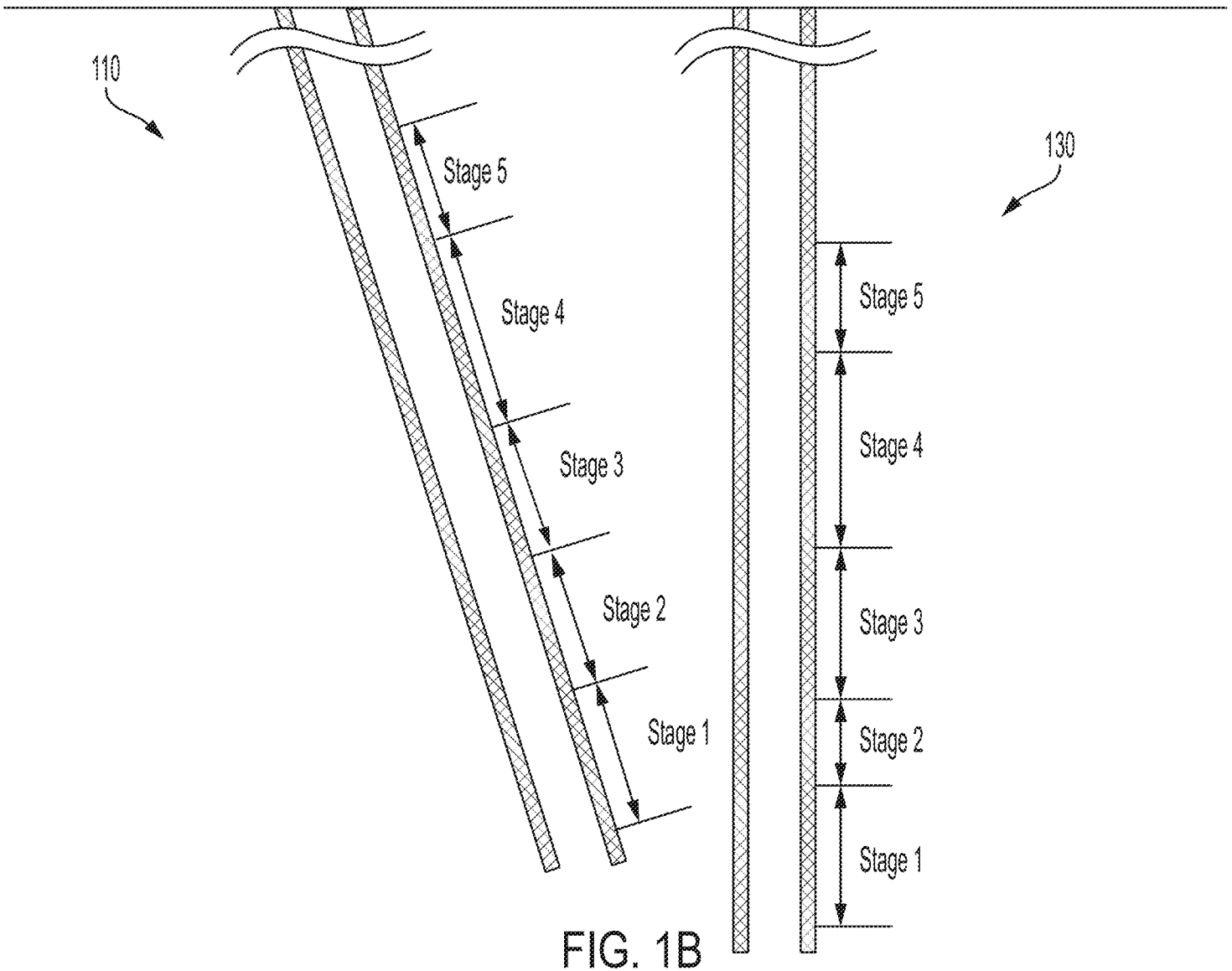

The parent well 100 and the child well 120 are shown as being substantially parallel in FIG. 1A. However, the parent well 100 and the child well 120 may be drilled at any suitable angle relative to one another. For example, FIG. 1B depicts two well systems 110, 130. In some aspects of the present disclosure, the well system 110 may be a parent well (hereinafter "parent well" 110), and the well system 130 may be a child well (hereinafter "child well 130"). The parent well 110 and the child well 130 may be drilled at an angle relative to one another, for example, as shown in FIG. 1B the parent well 110 and child well 130 are drilled at approximately 20° relative to one another. In some aspects, the parent well 110 may have stages 1-5, and the child well 130 may have stages 1-5. Due to the angle and proximity between the parent well 110 and the child well 130, select stages of the parent well 110 may have the potential to interact with particular stages of the child well 130.

In FIG. 1B, similar to FIG. 1A, the stage of the parent well 110 that may potentially interact with the stage of the child well 130 during fracturing of the stage of the child well 130 may be determined based on whether the stage of the parent well 110 and the stage of the child well 130 lie in substantially the same plane. For example, the hydraulic fracturing of Stage 1 of the child well 130 may potentially interact with Stage 1 of the parent well 110. The hydraulic fracturing of Stage 2 of the child well 130 may potentially interact with Stage 1 of the parent well 110. The hydraulic fracturing of Stage 3 of the child well 130 may potentially interact with Stages 1 and 2 of the parent well 110. The hydraulic fracturing of Stage 4 of the child well 130 may potentially interact with Stages 2, 3, and 4 of the parent well 110. And the hydraulic fracturing of Stage 5 of the child well 130 may potentially interact with Stage 4 of the parent well 110.

When the child well stage and the parent well stage(s) that may experience a frac hit during the hydraulic fracturing of the child well stage are identified, a system may be used to provide pinpoint stimulation to the identified parent well stages to pressurize the identified parent well stages during the hydraulic fracturing of the identified child well stage.

Figure 2:
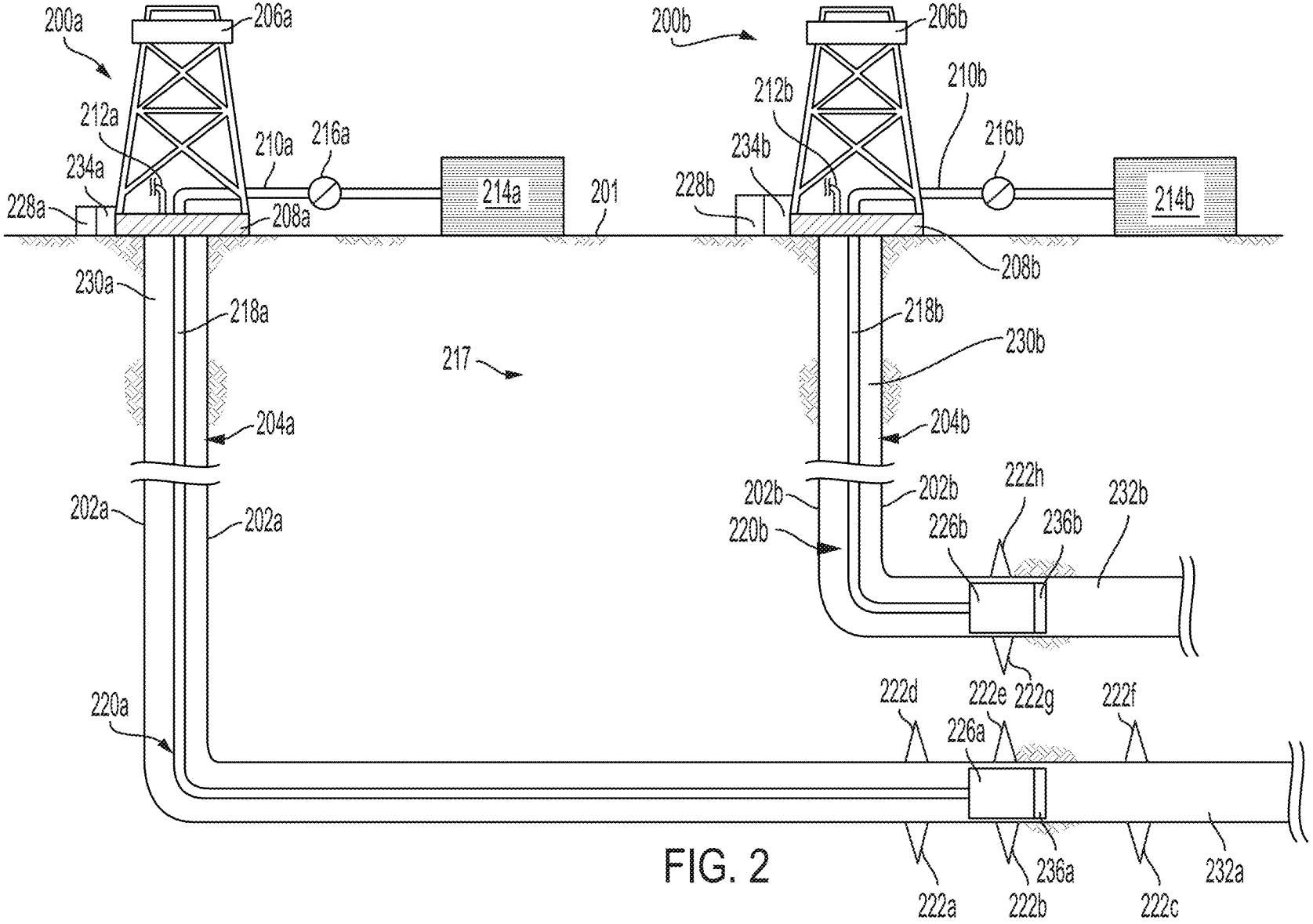
FIG. 2 is a cross-sectional view of examples of two well systems identified as a parent well and a child well incorporating a method of pressurizing and protecting the parent well during fracturing of the child well according to some aspects of the present disclosure.

FIG. 2 is a cross-sectional view of an example of two well systems 200*a*, 200*b* that may incorporate a method of pressurizing and protecting a parent well during fracturing of a child well according to some aspects of the present disclosure. The well systems 200*a*, 200*b* may be similar to or the same as the well systems 100, 110, 120, and 130 described above with respect to FIGS. 1A, 1B. Here, the well system 200*a* may be the parent well (hereinafter "parent well 200*a*") that includes a parent wellbore 204*a*, and the well system 200*b* may be the child well (hereinafter "child well 200*b*") that includes a child wellbore 204*b*. The wellbores 204*a*, 204*b* extend from a surface 201 through the earth. A casing 202*a*, 202*b* may be positioned in each wellbore 204*a*, 204*b*. The well systems 200*a*, 200*b* may have been constructed and completed in any suitable manner, such as by use of a drilling assembly having a drill bit for creating the wellbore 204*a*, 204*b*. Each casing 202*a*, 202*b* may extend for a length of the respective wellbore 204*a*, 204*b* and may help support the stability of the respective wellbore 204*a*, 204*b*. Each casing 202*a*, 202*b* may include tubular casing sections connected by end-to-end couplings. In some aspects, each casing 202*a*, 202*b* may be made of a suitable material such as steel. In some aspects, cement may be injected into each wellbore 204*a*, 204*b* and allowed to set between an outer surface of each casing 202*a*, 202*b* and an inner surface of the respective wellbore 204*a*, 204*b*. The wellbores 204*a*, 204*b* may each include a substantially vertical section 230*a*, 230*b* and a substantially horizontal section 232*a*, 232*b*.

At the surface, the well systems 200*a*, 200*b* may each include a derrick 206*a*, 206*b* positioned over a respective wellhead 208*a*, 208*b*. A pressure monitoring system 228*a*, 228*b* may be included in the well systems 200*a*, 200*b*. Each pressure monitoring system 228*a*, 228*b* may be in communication with a surface gauge 234*a*, 234*b* or a bottomhole gauge 236*a*, 236*b* for monitoring a pressure associated with each of the well systems 200*a*, 200*b*. While each pressure monitoring system 228*a*, 228*b* is shown adjacent to the respective wellhead 208*a*, 208*b*, each pressure monitoring system 228*a*, 228*b* may be located at any suitable location in the respective well systems 200*a*, 200*b*. Additionally, while each surface gauge 234*a*, 234*b* is shown proximate to the pressure monitoring system 228*a*, 228*b*, each surface gauge 234*a*, 234*b* may be located at any suitable location in the respective well systems 200*a*, 200*b*. Finally, while each bottomhole gauge 236*a*, 236*b* is shown proximate to a pinpoint stimulation system 220*a*, 220*b*, each bottomhole gauge 236*a*, 236*b* may be located at any suitable location in the respective parent and/or child wells 200*a*, 200*b*.

Each parent and/or child well 200*a*, 200*b* may include a pinpoint stimulation system 220*a*, 220*b*. Each pinpoint stimulation system 220*a*, 220*b* pumps a fluid into the respective parent and/or child well 200*a*, 200*b* via one or more lines 210*a*, 210*b*, 212*a*, 212*b*. Each wellhead 208*a*, 208*b* may be in fluid communication with the multitude of lines 210*a*, 210*b*, 212*a*, and 212*b*. For example, a high-pressure line 210*a*, 210*b* is depicted along with a production line 212*a*, 212*b*. Each high-pressure line 210*a*, 210*b* may be in fluid communication with a respective mixing tank 214*a*, 214*b*, in which fluids, such as a treatment fluid, may be mixed or stored for insertion into the respective parent and/or child wellbore 204*a*, 204*b* or into a respective coiled tubing 218*a*, 218*b* of the respective pinpoint stimulation system 220*a*, 220*b*.

Each pinpoint stimulation system 220*a*, 220*b* may stimulate one or more of the well stage(s) in the corresponding parent and/or child wellbore 204*a*, 204*b* while the other well stage(s) remain unstimulated. The pinpoint stimulation system 220*b* may be used to create or enhance newly formed fractures in a specific stage of the child wellbore 204*b* during the hydraulic fracturing of the child well 200*b*. The pinpoint stimulation system 220*a* may be used to further treat and/or pressurize a specific stage of the parent well 200*a* to provide a dynamic pressure cloud protecting the specific stage of the parent well 200*a* during hydraulic fracturing of the child well 200*b*. In some examples, the fracturing system 126 discussed above in relation to FIG. 1A may be the same as the pinpoint stimulation system 220*b*.

Each production line 210*a*, 210*b* may be used to produce fluids or gases from within the respective wellbore 204*a*, 204*b* to the surface. The fluids produced using each production line 212*a*, 212*b* may be hydrocarbon fluids from the formation 217 surrounding the respective wellbore 204*a*, 204*b* or treatment fluids from after a pinpoint stimulation operation has been completed.

Each well system 200*a*, 200*b* may also include a pump 216*a*, 216*b* for pumping or injecting a treatment fluid into the coiled tubing 218*a*, 218*b* as part the pressurization process utilizing the pinpoint stimulation system 220*a*, 220*b*. Each pump 216*a*, 216*b* may also inject the treatment fluid into the respective wellbore 204*a*, 204*b* or into the respective coiled tubing 218*a*, 218*b* as part of the hydraulic fracturing process. While the pinpoint stimulation system 220*b* is shown as being used to fracture the child wellbore 204*b*, any other suitable system or method may be used to fracture the child wellbore 204*b*.

During the hydraulic fracturing process, the treatment fluid can form the perforations through the outer surface of the casing 202*b*, the cement, and may form one or more fractures 222*a-h* in the formation 217, such as the fractures 122*a*, 122*b* described above in relation to FIG. 1A. The treatment fluid can include proppant for propping the fractures 222*a-h* open such that production fluid can flow from the formation 217 into the wellbore 204*b*. The treatment fluid may also be output to already formed fractures 222*a-f* to pressurize select stages of the parent well 200*a* and create a dynamic pressure cloud around the lower pressure reservoirs of the parent well 200*a*.

Each pinpoint stimulation system 220*a*, 220*b*, which may otherwise be referred to as the pinpoint coiled tubing system, may include the coiled tubing 218*a*, 218*b*, which is capable of travelling to the most downhole portion of the respective wellbore 204*a*, 204*b*, and a hydrajetting tool 226*a*, 226*b*, which may each include a set of packers. Each hydrajetting tool 226*a*, 226*b* may also include any suitable number of fluid jet nozzles found on the outer circumference of the respective hydrajetting tool 226*a*, 226*b*. Each pinpoint stimulation system 220*a*, 220*b* permits the treatment fluid to be output at a specific desired location throughout the respective wellbore 204*a*, 204*b*.

The pinpoint stimulation process used in each wellbore 204*a*, 204*b* may utilize the respective pinpoint stimulation system 220*a*, 220*b*. The operation may include positioning each hydrajetting tool 226*a*, 226*b* at a selected location in the respective wellbore 204*a*, 204*b*. The location may be selected based on where along the parent wellbore 204*a* needs to be pressurized during the hydraulic fracturing of the child wellbore 204*b*. In some aspects, the location may be selected based on where a fracture is intended to be made during the hydraulic fracturing of the child wellbore 204*b*.

The pinpoint stimulation process may include setting at least one packer at the selected location in each wellbore 204*a*, 204*b* to isolate the portion of the wellbore 204*a*, 204*b*, or the well stage, of interest. Setting at least one packer during the pinpoint stimulation process helps to ensure that the treatment fluid is output only to the selected location.

The pinpoint stimulation process may include outputting the treatment fluid through the hydrajetting tool 226*a*, 226*b*. During the hydraulic fracturing process, outputting the treatment fluid causes one or more fracture(s) 222*g*, 222*h* to form in the subterranean formation 217 at the selected location. During a pressurization process, outputting the treatment fluid causes the well stage at the selected location of the parent wellbore 204*a* to increase in pressure so that the dynamic pressure cloud causes the reservoir pressure around the select parent well stage to have an equal to or greater pressure than the unstimulated reservoir around the particular child well stage that will be hydraulically fractured.

Figure 3:
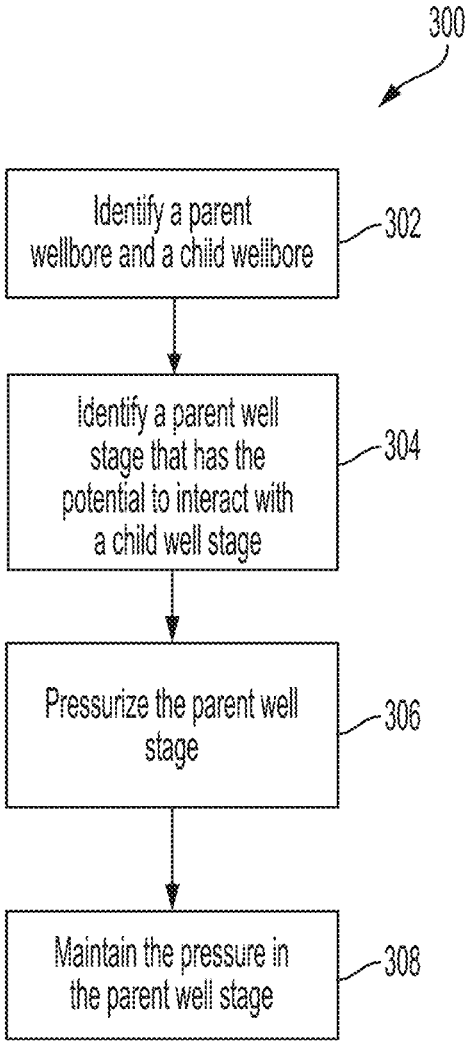
FIG. 3 is a flowchart of an exemplary process for pressurizing and protecting the parent well during fracturing of the child well according to some aspects of the present disclosure.

FIG. 3 is a flowchart of a process 300 for pressurizing and protecting a wellbore using pinpoint stimulation according to some aspects of the present disclosure. At step 302, the process 300 involves identifying a parent wellbore and a child wellbore. The parent wellbore and the child wellbore are selected based on whether a frac hit may potentially occur during the hydraulic fracturing of the child wellbore. For example, an child wellbore drilled in the same formation and proximate to (e.g., within a distance ranging from about 100 feet to about one mile, although in some aspects the child and parent wellbore may be farther apart or closer together) two parent wellbores (e.g., an infill well) may be identified as the parent wellbores and the child wellbore. A child wellbore drilled in the same formation and adjacent to (e.g., within a distance ranging from 100 feet to one mile, although in some aspects the child and parent wellbore may be farther apart or closer together) the parent wellbore may be identified as the parent wellbore and the child wellbore.

Various data and resources may be used to identify the parent wellbore and the child wellbore. For example, geographic maps of the wellbores in the area, historic parent well fracturing treatment data, completion design data, child well reservoir data. This treatment data may also include estimating the fracturing pressure of the child wellbore. Estimating the fracturing pressure of the child wellbore may help to determine which parent wellbores have the potential to interact with the child wellbore during the hydraulic fracturing of the child wellbore.

At step 304, the process 300 involves identifying a child well stage along the child wellbore that may be fractured and identifying a parent well stage along the parent wellbore that may interact with a child well stage along the child wellbore while the child wellbore undergoes hydraulic fracturing. As the child wellbore undergoes hydraulic fracturing, the fractures of the child wellbore may interact with the existing fractures of the parent wellbore due to the pressure differential between the existing fracture of the parent wellbore and the fracturing of the new fractures of the child wellbore. In some aspects, the parent well stage that is in substantially the same plane, or field, as the child well stage currently undergoing hydraulic fracturing may be susceptible to a frac hit caused by the hydraulic fracturing of the child well stage. External data, such as the mineral composition of the production region through which the fractures of the child wellbore will be made, data used to identify the parent wellbore and the child wellbore, or other data or statistics, may be used to determine the parent well stage that may potentially interact with the particular child well stage. In some aspects, multiple parent well stages may interact with a single child well stage, depending on the configuration of the parent wellbore and the child wellbore.

At step 306, the process 300 involves pressurizing the parent well stage to a pressure that is equal to or greater than the pressure in the particular child well stage during the hydraulic fracturing of the child well stage to provide a dynamic pressure cloud by pumping a treatment fluid downhole to the parent well stage identified as potentially interacting with the particular child stage to be fractured using a pinpoint stimulation system. The treatment fluid can be any suitable fluid, which may include a liquid, a gas, or a mixture of liquids and gases, including water, a gel (e.g., guar, guar derivatives), surfactant-treated water, gases or foams (e.g., nitrogen, carbon dioxide, liquefied natural gas or natural gas in any composition, and foams of nitrogen or carbon dioxide), acids, scale treatment fluids, paraffin treatment fluids, asphaltene treatment fluids, conformance control additives, etc. The treatment fluid may simultaneously treat and pressurize the parent well stage in order to improve the production of the parent wellbore. The treatment fluid may also have additional benefits to the parent wellbore. For example, the treatment fluid may include additional proppant that may remain in the fractures after the pressurization process to increase production of the parent wellbore. After the identified parent well stage has been pressurized in step 306, the particular child well stage may be fractured.

At step 308, the process 300 involves maintaining a pressure in the parent well stage that is equal to or greater than the pressure in the child well stage while the child well stage continues to undergo hydraulic fracturing. If the pressure in the parent well stage is equal to or greater than the pressure in the child well stage that is undergoing hydraulic fracturing, the pressure in the parent well stage may protect the parent well stage and reduce the chance of a frac hit occurring while the child well stage is fractured. Maintaining the pressure in the parent well stage may include monitoring the pressure in the parent well stage. In some aspects, the pressure to be monitored is the bottomhole treating pressure. In some aspects, the pressure may be monitored using a surface gauge or a bottomhole gauge, which may provide a higher level of accuracy.

Maintaining the pressure in the parent well stage may include adjusting the output rate of the treatment fluid based on a detected pressure change occurring in the parent well stage. For example, the output rate, or injection rate, of the treatment fluid may be increased to increase the pressure in the parent well stage in response to detecting that the pressure of the parent well stage is less than the pressure of the child well stage.

After the child well stage has undergone the hydraulic fracturing, the hydraulic fracturing in the child well stage may be stopped. The pressurization in the corresponding parent well stage(s) may also be stopped. One or more child well stage(s) may be identified to undergo hydraulic fracturing next and the corresponding parent well stage(s) along the parent wellbore that may interact with the child well stage(s) may be identified and subjected to the pressurization process. The pinpoint stimulation system may pressurize a second parent well stage by pumping the treatment fluid downhole to the second parent well stage using the pinpoint stimulation system. The pinpoint stimulation system may maintain a pressure at the relevant parent stage that is equal to or greater pressure than the pressure of the second child well stage while the second child well stage undergoes the hydraulic fracturing. In some aspects, each parent well stage identified as potentially interacting with a child well stage being fractured may be treated as described above in steps 304-308.

Figure 4:
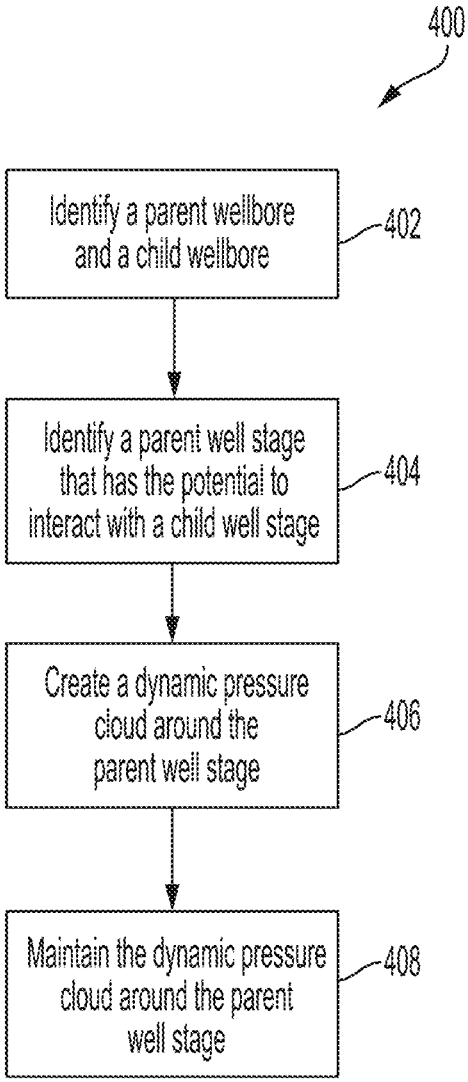
FIG. 4 is a flowchart of an additional exemplary process for pressurizing and protecting the parent well during fracturing of the child well according to some aspects of the present disclosure.

FIG. 4 is a flowchart of an exemplary process 400 for pressurizing and protecting a wellbore according to some aspects of the present disclosure. At step 402, the process 400 may include identifying a parent wellbore and a child wellbore. At step 404, the process 400 may include identifying a parent well stage located in the parent wellbore that may interact with a child well stage to be fractured in the child wellbore.

At step 406, the process 400 may include creating a dynamic pressure cloud around the parent well stage by pumping a treatment fluid to the parent well stage to pressurize the parent well stage, for example but not limited to using a pinpoint stimulation system. The dynamic pressure cloud may protect the parent well stage from interacting with the corresponding child well stage undergoing hydraulic fracturing by providing a pressure in the parent well stage being treated that is greater than the pressure in the corresponding child well stage. In some aspects, the dynamic pressure cloud may protect the parent well stage from interacting with the corresponding child well stage undergoing hydraulic fracturing by providing a pressure in the parent well stage being treated that is equal to or greater than the pressure in the corresponding child well stage.

At step 408, the process 400 may include maintaining the dynamic pressure cloud around the parent well stage while the child well stage undergoes hydraulic fracturing such that the pressure of the parent well stage is equal to or greater than the pressure of the child well stage. The pressure of the parent well stage and the child well stage may be determined by a surface gauge or a pressure gauge in each respective wellbore. Steps 404-408 may be repeated for each child well stage that undergoes hydraulic fracturing until the child wellbore has been fully treated.

Figure 5:
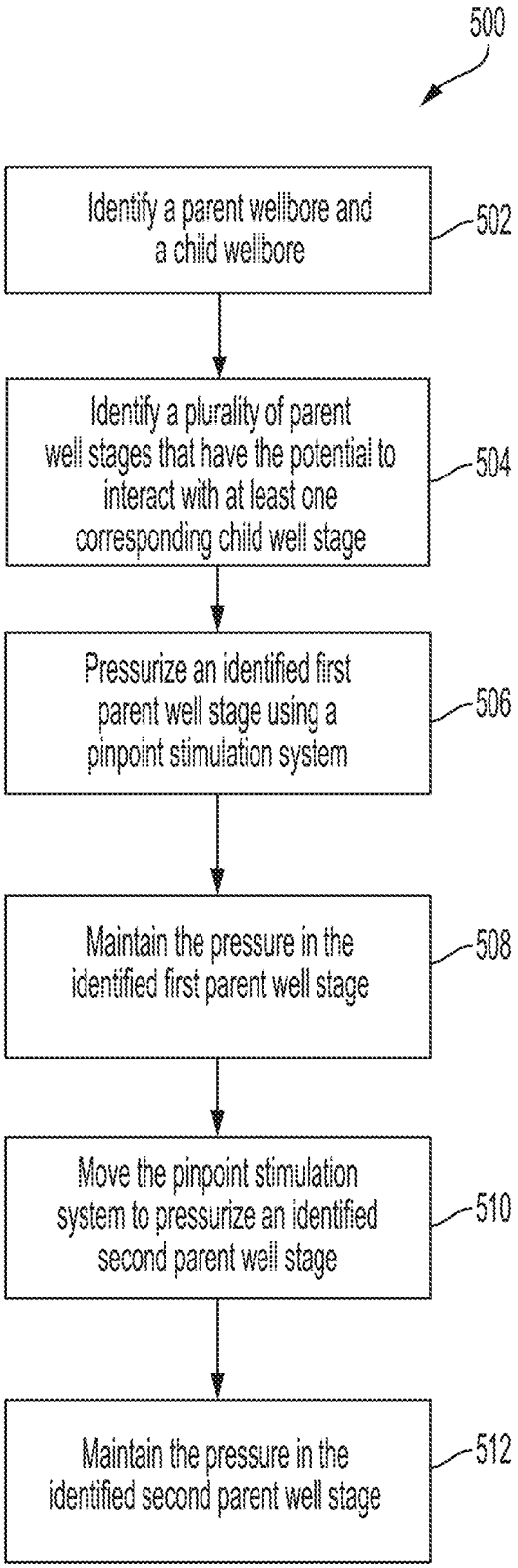
FIG. 5 is a flowchart of an additional exemplary process for pressurizing and protecting the parent well during fracturing of the child well according to some aspects of the present disclosure.

FIG. 5 is a flowchart of another exemplary process 500 for pressurizing and protecting a wellbore using a pinpoint stimulation system according to some aspects of the present disclosure.

At step 502, similar to process 300 and 400 discussed above, the process 500 may include identifying a parent wellbore and a child wellbore. At step 504, the process 500 may include identifying a plurality of parent well stages within the parent wellbore that may potentially interact with at least one corresponding child well stage within the child wellbore as the child wellbore undergoes hydraulic fracturing.

At step 506, the process 500 may include pressurizing an identified first parent well stage by pumping a treatment fluid downhole to the identified first parent well stage and pressurizing the parent well stage to a pressure that is equal to or greater than the pressure in the at least one corresponding child well stage while the at least one corresponding child well stage undergoes hydraulic fracturing using a pinpoint stimulation system. In some examples, pressurizing the parent well stages may include deploying the pinpoint stimulation system to a first identified parent well stage located farthest downhole of all the identified stages in the parent wellbore. The pinpoint stimulation system may include a hydrajetting tool 226*a*, as discussed above in relation to FIG. 2, and at least two packers may be set in the wellbore to isolate the identified parent well stage.

At step 508, the process 500 may include maintaining a pressure in the identified first parent well stage that is equal to or greater than the pressure in the at least one corresponding child well stage while the at least one corresponding child well stage undergoes the hydraulic fracturing.

At step 510, the process 500 may include moving the pinpoint stimulation system to pressurize an identified second parent well stage by pumping the treatment fluid downhole to the identified second parent well stage using the pinpoint stimulation system. The pinpoint stimulation system may move from a first parent well stage to a second parent well stage after a first child well stage has been fractured and the fracturing system in the child well moves to perform the fracturing of a second child well stage. In some aspects, moving the pinpoint stimulation system may include unseating the at least two packers using the coiled tubing of the pinpoint stimulation system.

At step 512, the process 500 may include maintaining the pressure in the identified second parent well stage that is equal to or greater than the pressure in the at least one corresponding child well stage (e.g., the second child well stage) while the at least one corresponding child well stage undergoes the hydraulic fracturing.

Figure 6:
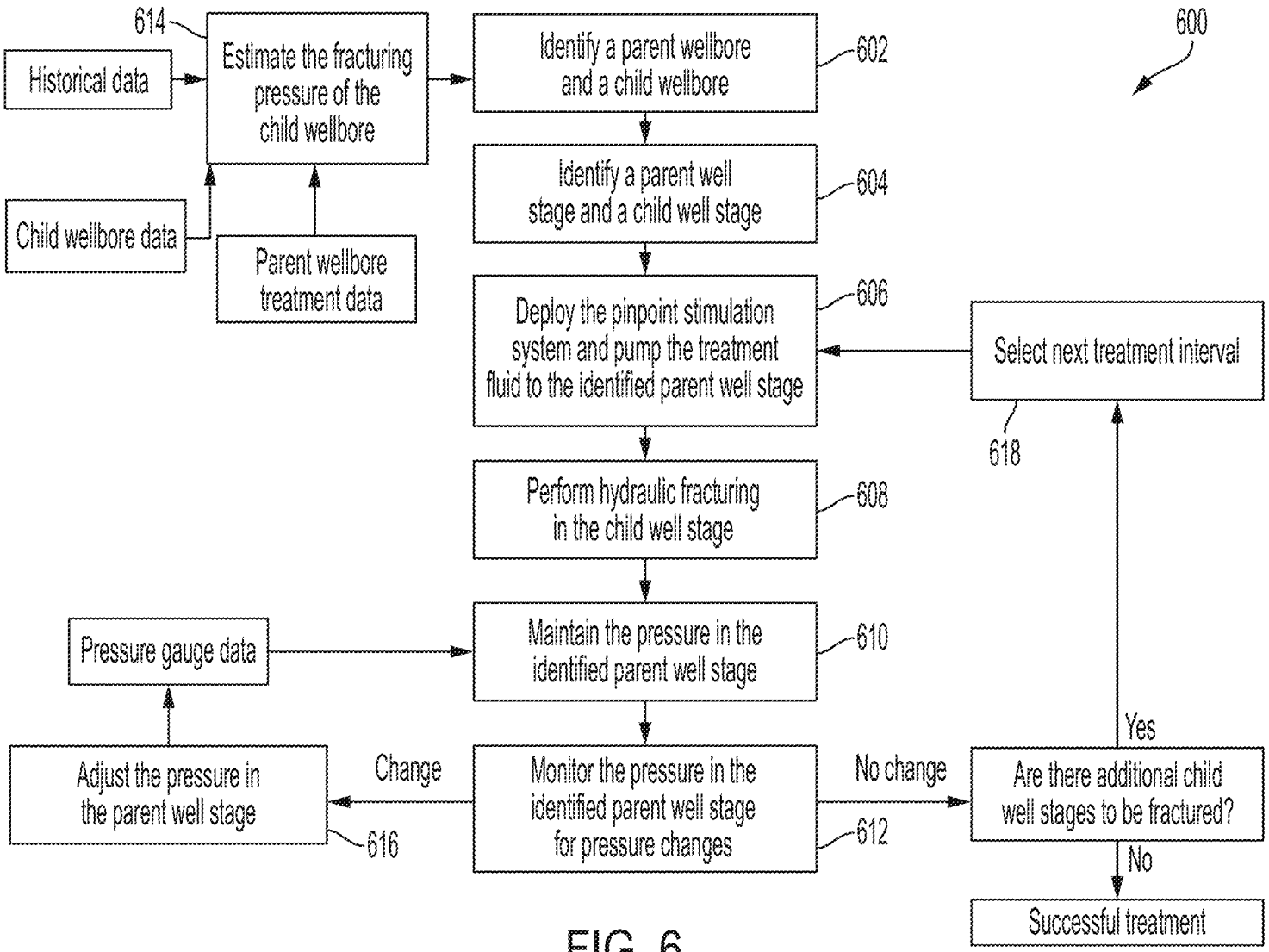
FIG. 6 is a flowchart of an additional exemplary process for pressurizing and protecting the parent well during fracturing of the child well according to some aspects of the present disclosure.

FIG. 6 is a flowchart of another exemplary process 600 for pressurizing and protecting a wellbore using a pinpoint stimulation system according to some aspects of the present disclosure.

At step 602, the process 600 may include identifying a parent wellbore and a child wellbore. Identifying the parent and child wellbore may include step 614 that includes estimating the fracturing pressure of the child wellbore. Various data and resources may be used to estimate the fracturing pressure of the child wellbore, such as historical data, child wellbore data, and parent wellbore treatment data.

At step 604, the process 600 may include identifying a parent well stage and a child well stage that have the potential to interact during the fracturing of the child well stage. At step 606, the process 600 may include deploying a pinpoint stimulation system to the identified parent well stage and pumping the treatment fluid to the identified parent well stage to pressurize the identified parent well stage to a pressure that is equal to or greater than the pressure in the corresponding child well stage during the fracturing of the corresponding child well stage.

At step 608, the process 600 may include performing hydraulic fracturing in the child well stage while the identified parent well stage is pressurized using the pinpoint stimulation system.

At step 610, the process 600 may include maintaining the pressure in the identified parent well stage such that the pressure in the identified parent well stage is equal to or greater than the pressure in the corresponding child well stage during the fracturing of the child well stage.

At step 612, the process 600 may include monitoring the pressure in the identified parent well stage for pressure changes. If a pressure change is detected, then at step 616, the process 600 may include adjusting the pressure in the parent well stage by adjusting the output rate of the treatment fluid by the pinpoint stimulation system. Pressure gauge data from a pressure monitoring system, a surface gauge, or a bottomhole gauge may be used in steps 610-616.

If no pressure change is detected at step 612, the child well stage undergoing fracturing has been completely fractured, and there are still additional child well stages to be fractured in the child wellbore, then the process 600 may proceed to step 618 which may include selecting the next treatment interval. In some aspects, step 618 includes selecting the next child well stage to be fractured during the fracturing process. The process 600 may then return to step 606 to repeat steps 606-612 for each child well stage to be fractured in the child wellbore.

If no pressure change is detected at step 612, the child well stage undergoing fracturing has been completely fractured, and there are no additional child well stages to be fractured in the child wellbore, then the treatment of the parent wellbore and the child wellbore is completed.

In some aspects, methods for pressurizing and protecting a wellbore using pinpoint stimulation are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a method for protecting a wellbore comprising: identifying a parent wellbore and a child wellbore; identifying a parent well stage along the parent wellbore that has the potential to interact with a child well stage along the child wellbore while the child well stage undergoes hydraulic fracturing; pumping a treatment fluid downhole to the parent well stage for pressurizing the parent well stage to a pressure that is equal to or greater than the pressure in the child well stage while the child well stage undergoes hydraulic fracturing; and maintaining the pressure in the parent well stage that is equal to or greater than the pressure in the child well stage while the child well stage undergoes hydraulic fracturing.

Example 2 is the method of example 1, wherein pumping the treatment fluid downhole to the parent well stage pressurizes the parent well stage to a pressure that is greater than the pressure in the child well stage while the child well stage undergoes hydraulic fracturing.

Example 3 is the method of example 1-2, wherein maintaining the pressure in the parent well stage further comprises adjusting an output rate of the treatment fluid based on a pressure change occurring in the parent well stage.

Example 4 is the method of example 1-3, wherein maintaining the pressure in the parent well stage further comprises increasing the pressure in the parent well stage by increasing the output rate of the treatment fluid in response to the pressure of the parent well stage being less than the pressure of the child well stage.

Example 5 is the method of example(s) 1-4, wherein a pinpoint stimulation system is used for pumping the treatment fluid downhole to only the parent well stage.

Example 6 is the method of example(s) 1-5, further comprising: identifying a second parent well stage along the parent wellbore that has the potential to interact with a second child well stage along the child wellbore while the second child well stage undergoes hydraulic fracturing; pumping the treatment fluid downhole to the second parent well stage for pressurizing the second parent well stage to the pressure that is equal to or greater than the pressure in the second child well stage while the second child well stage undergoes hydraulic fracturing; and maintaining the pressure in the second parent well stage that is equal to or greater than the pressure in the second child well stage while the second child well stage undergoes hydraulic fracturing.

Example 7 is a method for protecting a wellbore comprising: identifying a parent wellbore and a child wellbore; identifying a parent well stage located in the parent wellbore that has the potential to interact with a child well stage located in the child wellbore; creating a dynamic pressure cloud around the parent well stage by pumping a treatment fluid to the parent well stage for pressurizing the parent well stage to a pressure that is equal to or greater than the pressure in the child well stage while the child well stage undergoes hydraulic fracturing; and maintaining the dynamic pressure cloud around the parent well stage while the child well stage undergoes hydraulic fracturing.

Example 8 is the method of example 7, wherein the treatment fluid is pumped to the parent well stage for pressurizing the parent well stage to a pressure that is greater than the pressure in the child well stage while the child well stage undergoes hydraulic fracturing.

Example 9 is the method of example(s) 7-8, further comprising: stopping the hydraulic fracturing of the child well stage; and stopping the pumping of the treatment fluid to the parent well stage.

Example 10 is the method of example 9, further comprising: identifying a second parent well stage located in the parent wellbore that has the potential to interact with the child well stage in the child wellbore; creating the dynamic pressure cloud around the second parent well stage by pumping the treatment fluid to the second parent well stage for pressurizing the second parent well stage to the pressure that is equal to or greater than the pressure in the child well stage while the child well stage undergoes hydraulic fracturing; and maintaining the dynamic pressure cloud around both the parent well stage and the second parent well stage while the child well stage undergoes the hydraulic fracturing so that the pressure of both the parent well stage and the second parent well stage is equal to or greater than the pressure of the child well stage.

Example 11 is the method of example(s) 7-10, wherein identifying the parent well stage comprises identifying each parent well stage along an entire length of the parent wellbore that has the potential to experience an interaction with the child well stage as the child well stage undergoes the hydraulic fracturing.

Example 12 is the method of example(s) 7-11, wherein identifying the parent wellbore and the child wellbore and identifying the parent well stage that has the potential to interact with the child well stage comprises utilizing at least one of historic parent well fracturing treatment data, completion design data, or child well reservoir data.

Example 13 is the method of example(s) 7-12, wherein identifying the parent wellbore and the child wellbore comprises estimating a fracturing pressure of the child wellbore.

Example 14 is the method of example(s) 7-13, wherein identifying the parent well stage that has the potential to interact with the child well stage comprises determining the child well stage that lies in substantially the same plane as the parent well stage.

Example 15 is the method of example(s) 7-14, wherein creating the dynamic pressure cloud around the parent well stage comprises using a pinpoint stimulation system that stimulates one or more of the parent well stages while other parent well stages remain unstimulated.

Example 16 is a method for protecting a wellbore comprising: identifying a parent wellbore and a child wellbore; identifying a plurality of parent well stages within the parent wellbore that has the potential to interact with at least one corresponding child well stage within the child wellbore as the child wellbore undergoes hydraulic fracturing; pressurizing an identified first parent well stage to a pressure that is greater than the pressure in the at least one corresponding child well stage while the at least one corresponding child well stage undergoes hydraulic fracturing by pumping a treatment fluid downhole to the identified first parent well stage using a pinpoint stimulation system; maintaining the pressure in the identified first parent well stage that is greater than the pressure in the at least one corresponding child well stage while the at least one corresponding child well stage undergoes the hydraulic fracturing; moving the pinpoint stimulation system to pressurize an identified second parent well stage to the pressure that is greater than the pressure in the at least one corresponding child well stage while the at least one corresponding child well stage undergoes hydraulic fracturing by pumping the treatment fluid downhole to the identified second parent well stage using the pinpoint stimulation system; and maintaining the pressure in the identified second parent well stage that is greater than the pressure in the at least one corresponding child well stage while the at least one corresponding child well stage undergoes the hydraulic fracturing.

Example 17 is the method of example 16, wherein pressurizing the identified first parent well stage or the identified second parent well stage using the pinpoint stimulation system comprises deploying the pinpoint stimulation system to the identified first parent well stage or the identified second parent well stage at the deepest location in the parent wellbore.

Example 18 is the method of example(s) 16-17, wherein pressurizing the identified first parent well stage or the second parent well stage using the pinpoint stimulation system comprises setting at least two packers to isolate the identified first parent well stage or the second parent well stage.

Example 19 is the method of example 18, wherein moving the pinpoint stimulation system comprises unseating the at least two packers using a coil of the pinpoint stimulation system.

Example 20 is the method of example(s) 16-19, wherein the treatment fluid simultaneously treats the identified first parent well stage or the second parent well stage while pressurizing the identified first parent well stage or the second parent well stage.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A method for protecting a wellbore comprising:

identifying a parent wellbore and a child wellbore;

identifying a parent well stage along the parent wellbore that has the potential to interact with a child well stage along the child wellbore while the child well stage undergoes hydraulic fracturing, wherein the parent well stage is a length of the parent wellbore that is less than the entire length of the parent wellbore, wherein the child well stage is a length of the child wellbore that is less than the entire length of the child wellbore, wherein an axial plane is perpendicular to a longitudinal axis of the child wellbore, and wherein the axial plane of the child well stage intersects the parent well stage;

pumping a treatment fluid downhole to the parent well stage for pressurizing the parent well stage to a pressure that is equal to or greater than a pressure in the child well stage while the child well stage undergoes hydraulic fracturing;

maintaining the pressure in the parent well stage that is equal to or greater than the pressure in the child well stage while the child well stage undergoes hydraulic fracturing, wherein maintaining the pressure in the parent well stage further comprises adjusting an output rate of the treatment fluid based on a pressure change detected in the parent well stage;

identifying a second parent well stage along the parent wellbore that has the potential to interact with a second child well stage along the child wellbore while the second child well stage undergoes hydraulic fracturing;

pumping the treatment fluid downhole to the second parent well stage for pressurizing the second parent well stage to a pressure that is equal to or greater than a pressure in the second child well stage while the second child well stage undergoes hydraulic fracturing; and maintaining the pressure in the second parent well stage that is equal to or greater than the pressure in the second child well stage while the second child well stage undergoes hydraulic fracturing.

2. The method of claim 1, wherein pumping the treatment fluid downhole to the parent well stage pressurizes the parent well stage to a pressure that is greater than the pressure in the child well stage while the child well stage undergoes hydraulic fracturing.

3. The method of claim 1, wherein maintaining the pressure in the parent well stage further comprises increasing the pressure in the parent well stage by increasing the output rate of the treatment fluid in response to the pressure of the parent well stage being less than the pressure of the child well stage.

4. The method of claim 1, wherein a pinpoint stimulation system is used for pumping the treatment fluid downhole to only the parent well stage.

5. The method of claim 1, wherein identifying the parent well stage comprises identifying each parent well stage along an entire length of the parent wellbore that has the potential to experience an interaction with the child well stage as the child well stage undergoes the hydraulic fracturing.

6. A method for protecting a wellbore comprising:

identifying a parent wellbore and a child wellbore;

identifying a parent well stage located in the parent wellbore that has the potential to interact with a child well stage located in the child wellbore, wherein the parent well stage is a length of the parent wellbore that is less than the entire length of the parent wellbore, wherein the child well stage is a length of the child wellbore that is less than the entire length of the child wellbore, wherein an axial plane is perpendicular to a longitudinal axis of the child wellbore, and wherein the parent well stage lies in substantially the same axial plane as the child well stage;

creating a dynamic pressure cloud around the parent well stage by pumping a treatment fluid to the parent well stage for pressurizing the parent well stage to a pressure that is equal to or greater than a pressure in the child well stage while the child well stage undergoes hydraulic fracturing;

maintaining the dynamic pressure cloud around the parent well stage while the child well stage undergoes hydraulic fracturing;

identifying a second parent well stage located in the parent wellbore that has the potential to interact with the child well stage in the child wellbore;

creating the dynamic pressure cloud around the second parent well stage by pumping the treatment fluid to the second parent well stage for pressurizing the second parent well stage to a pressure that is equal to or greater than the pressure in the child well stage while the child well stage undergoes hydraulic fracturing; and maintaining the dynamic pressure cloud around both the parent well stage and the second parent well stage while the child well stage undergoes the hydraulic fracturing so that the pressure of both the parent well stage and the second parent well stage is equal to or greater than the pressure of the child well stage.

7. The method of claim 6, wherein the treatment fluid is pumped to the parent well stage for pressurizing the parent well stage to a pressure that is greater than the pressure in the child well stage while the child well stage undergoes hydraulic fracturing.

8. The method of claim 6, further comprising:

stopping the hydraulic fracturing of the child well stage; and stopping the pumping of the treatment fluid to the parent well stage.

9. The method of claim 6, wherein identifying the parent well stage comprises identifying each parent well stage along the entire length of the parent wellbore that has the potential to experience an interaction with the child well stage as the child well stage undergoes the hydraulic fracturing.

10. The method of claim 6, wherein identifying the parent wellbore and the child wellbore and identifying the parent well stage that has the potential to interact with the child well stage comprises utilizing at least one of historic parent well fracturing treatment data, completion design data, or child well reservoir data.

11. The method of claim 6, wherein identifying the parent wellbore and the child wellbore comprises estimating a fracturing pressure of the child wellbore.

12. The method of claim 6, wherein creating the dynamic pressure cloud around the parent well stage comprises using a pinpoint stimulation system that stimulates the parent well stage while other parent well stages remain unstimulated.

13. The method of claim 6, wherein maintaining the dynamic pressure cloud around the parent well stage and the second parent well stage further comprises adjusting an output rate of the treatment fluid based on a pressure change detected in at least one of the parent well stage and the second parent well stage.

14. A method for protecting a wellbore comprising:

identifying a parent wellbore and a child wellbore;

identifying a plurality of parent well stages within the parent wellbore, wherein each parent well stage of the plurality of parent well stages have a potential to interact with at least one corresponding child well stage within the child wellbore as the child wellbore undergoes hydraulic fracturing, wherein each parent well stage of the plurality of parent well stages is a length of the parent wellbore that is less than the entire length of the parent wellbore, wherein the at least one corresponding child well stage is a length of the child wellbore that is less than the entire length of the child wellbore, wherein an axial plane is perpendicular to a longitudinal axis of the child wellbore, and wherein the plurality of parent well stages lies in substantially the same axial plane as the at least one corresponding child well stage;

pressurizing an identified first parent well stage to a pressure that is greater than the pressure in the at least one corresponding child well stage while the at least one corresponding child well stage undergoes hydraulic fracturing by pumping a treatment fluid downhole to the identified first parent well stage using a pinpoint stimulation system;

maintaining the pressure in the identified first parent well stage that is greater than the pressure in the at least one corresponding child well stage while the at least one corresponding child well stage undergoes the hydraulic fracturing;

moving the pinpoint stimulation system to pressurize an identified second plurality of parent well stages that has the potential to interact with at least one corresponding second child well stage to the pressure that is greater than the pressure in the at least one corresponding second child well stage while the at least one corresponding second child well stage undergoes hydraulic fracturing by pumping the treatment fluid downhole to the identified second plurality of parent well stages using the pinpoint stimulation system; and maintaining the pressure in the identified second plurality of parent well stages that is greater than the pressure in the at least one corresponding second child well stage while the at least one corresponding second child well stage undergoes the hydraulic fracturing.

15. The method of claim 14, wherein pressurizing the identified first parent well stage or the identified second plurality of parent well stages using the pinpoint stimulation system comprises deploying the pinpoint stimulation system to the identified first parent well stage or the identified plurality of second parent well stages at the deepest location in the parent wellbore.

16. The method of claim 14, wherein pressurizing the identified first parent well stage or the identified plurality of second parent well stages using the pinpoint stimulation system comprises setting at least two packers to isolate the identified first parent well stage or the identified plurality of second parent well stages.

17. The method of claim 16, wherein moving the pinpoint stimulation system comprises unseating the at least two packers using a coil of the pinpoint stimulation system.

18. The method of claim 14, wherein the treatment fluid simultaneously treats the identified first parent well stage or the identified plurality of second parent well stages while pressurizing the identified first parent well stage or the identified plurality of second parent well stages.

* * * * *